US008733977B2

(12) United States Patent
Dan et al.

(10) Patent No.: US 8,733,977 B2
(45) Date of Patent: May 27, 2014

(54) LED LIGHT BULB

(75) Inventors: Yifan Dan, GuangDong (CN); Vincent Hui, Tsuen Wan (HK)

(73) Assignees: Glocal International Ltd., Hong Kong (CN); Dong Guan Apsun Lighting Technology Co., Ltd, GuangDong (CN)

( * ) Notice: Subject to any disclaimer, the term of this patent is extended or adjusted under 35 U.S.C. 154(b) by 0 days.

(21) Appl. No.: 13/551,211

(22) Filed: Jul. 17, 2012

(65) Prior Publication Data

US 2014/0022788 A1 Jan. 23, 2014

(51) Int. Cl.
*F21S 4/00* (2006.01)

(52) U.S. Cl.
USPC ..... 362/249.04; 257/88

(58) Field of Classification Search
USPC ..... 362/249.04; 257/87–89
See application file for complete search history.

(56) References Cited

U.S. PATENT DOCUMENTS

2007/0262323 A1* 11/2007 Sonobe et al. ..... 257/77
2009/0140271 A1* 6/2009 Sah ..... 257/88

* cited by examiner

*Primary Examiner* — Anne Hines
(74) *Attorney, Agent, or Firm* — Garcia-Zamor IP Law; Ruy M. Garcia-Zamor

(57) ABSTRACT

The invention discloses a novel LED (light-emitting diode) light bulb which comprises a light holder, a light cover and an LED light-emitting body, wherein the LED light-emitting body is composed of an LED light and a driving circuit board; the LED light is electrically connected with the driving circuit board; the driving circuit board is electrically connected with the light holder; the LED light-emitting body is installed in the light cover; and the light cover is installed on the light holder. The LED light bulb is simple in structure, has high universality, is energy saving and electricity saving, is convenient to maintain, has a long service life, is economical and practical, and is suitable for popularization and using.

10 Claims, 4 Drawing Sheets

LED LIGHT BULB

TECHNICAL FIELD

The invention relates to a light fitting, and in particular relates to an LED light bulb.

BACKGROUND ART

Since electricity has been invented, light fittings have been essential daily necessities in people's lives. Metal wires such as tungsten wire are mostly taken as light-emitting bodies for the traditional halogen bulbs. The light-emitting bodies of the bulbs are easy to be damaged, and the bulbs are need to be replaced frequently, not only inconvenience in use is brought about, but also waste is caused, because once the light filament is damaged, the whole bulb is required to be replaced. Because the amount of usage of the bulbs is great, the waste is amazing; besides, the energy consumption of the metal wire bulbs is great, quite a part of electricity energy is wasted on heating, similarly because the amount of usage is great, the energy source waste is also amazing.

INVENTION CONTENTS

The invention aims to provide a LED light bulb which is low in energy consumption, is economic and practical.

The aim of the invention can be realized through the following technical means: a novel LED light bulb, comprising a light holder which is internally provided with a metal element for connecting the power supply;

a light cover which is hollow and is installed on the holder;

an LED light-emitting body consisting of an a plurality of LED light lights and a driving circuit board comprising an outer surface toward the light cover, wherein the plurality of LED lights are distributed on the outer surface of the driving circuit board and electrically connected with the driving circuit board, and lights from the plurality of LED lights directly emits to the light cover; the driving circuit board is directly and electrically connected with the light holder; and the LED light-emitting body is installed in the light cover.

The driving circuit board can be designed to be of a strip shape.

The top end of the strip-shaped driving circuit board can be bent into an annular shape, and the LED lights are distributed on the outer surface of the annular driving circuit board.

The driving circuit board can be bent into a water-drop shape, and LED lights are distributed on the outer surface of the water-drop-shaped driving circuit board. Through the two kinds of design, the light sources are distributed more reasonably, and the lighting range is wider.

The driving circuit board also can be designed to be of a flat-plate-type structure, and the LED lights are distributed on the frontage surface of the driving circuit board.

In order to enhance heat radiation, a heat radiator is also installed on the back surface of the driving circuit board.

The appearance of the light cover can be designed to be of a spherical shape, namely the appearance of a bulb invented by Edison.

The appearance of the light cover can be designed to be of an olivary shape so as to meet the mounting requirement of certain smaller mounting space.

The appearance of the light cover can be designed to be of a flame type so as to match with the color of the LED light-emitting body, and special illumination and artistic effects can be achieved.

The appearance of the light cover also can be designed into different appearances according to different using occasions.

The plurality of LED lights are distributed on the outer surface of the driving circuit board irregularly.

The invention has the following beneficial effects: 1. The LED light bulb is simple in structure, and is high in universality, and a traditional structure of a bulb is adopted, so the light bulb can be applied to an old lighting device. 2. The LED light bulb is energy saving and electricity saving, compared with the traditional light bulb, the LED light-emitting body has obvious improvements and advantages in the energy-saving aspect because of its characteristics of low energy consumption and good lighting effect. 3. The LED light bulb is convenient to maintain, if the light-emitting body is damaged, as long as the light cover and the light-emitting body are dismounted, the light-emitting body or the circuit board can be maintained or replaced, and the whole light bulb is not required to be abandoned. 4. The LED light bulb has a long service life. Because the driving circuit board is provided with a plurality of LED light bulbs, if one LED light bulb is damaged in the using process, the lighting effect of the LED light bulb provided by the invention can not be affected obviously. The LED light bulb is not required to be maintained time to time, and a great amount of time is saved.

DETAILED DESCRIPTION OF THE PREFERRED EMBODIMENTS

Figure 1:
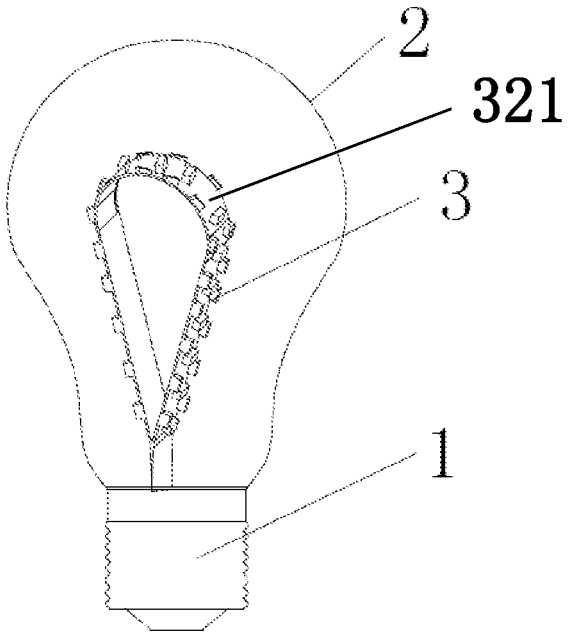
FIG. 1 shows the structural view of the embodiment 1.
Figure 2:
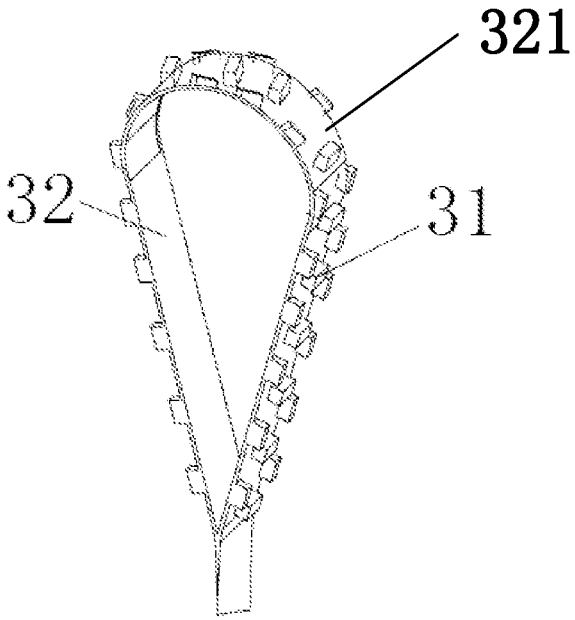
FIG. 2 shows the structural view of the embodiment 1 of the LED light-emitting body.

As the embodiment 1 shown by the FIG. 1 and the FIG. 2, the LED light is composed of a light holder 1 of the metal element for connecting the power supply, a hollow spherical light cover 2 and an LED light-emitting body 3, wherein the LED light-emitting body 3 is composed of a plurality of LED lights 31 and a strip-shaped driving circuit board 32 including an outer surface 321 toward the light cover 2; the driving circuit board is bent into a water-drop shape; LED lights are distributed on the outer surface 321 of the annular driving circuit board 32, and lights from the plurality of LED lights 31 directly emits to the light cover; the LED lights 31 are electrically connected with the driving circuit board 32; the driving circuit board 32 is directly and electrically connected with the light holder 3; and the light cover 2 is installed on the light holder 1, and the LED light-emitting body 3 is installed in the light cover. The plurality of LED lights 31 are distributed on the outer surface 321 of the driving circuit board 32 irregularly.

Figure 3:
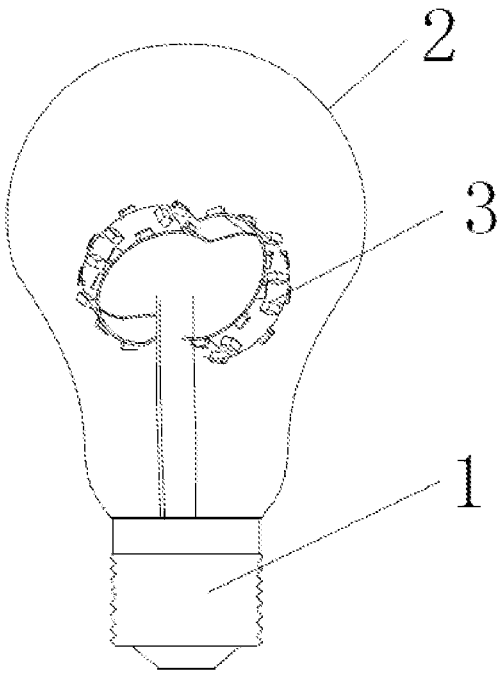
FIG. 3 shows the structural view of the embodiment 2.

Compared with the embodiment 1, the embodiment 2 shown by the FIG. 3 is characterized in that the top end of the driving circuit board 32 is driven to be bent into an annular structure.

Figure 4:
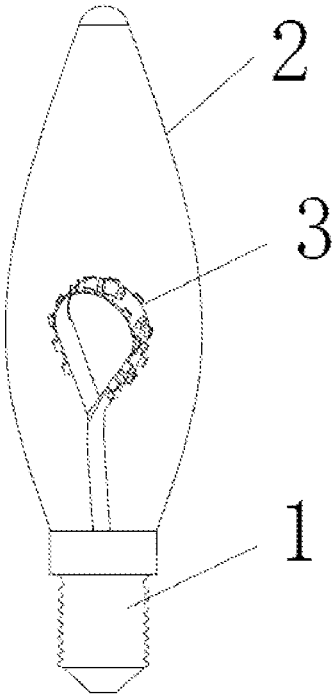
FIG. 4 shows the structural view of the embodiment 3.

Compared with the embodiment 1, the embodiment 3 shown by the FIG. 4 is characterized in that the appearance of the light cover 2 is olivary.

Figure 5:
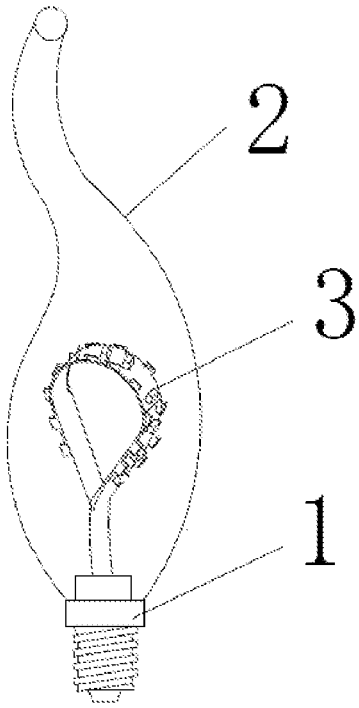
FIG. 5 shows the structural view of the embodiment 4.

Compared with the embodiment 1, the embodiment 4 shown by the FIG. 5 is characterized in that the appearance of the light cover 2 is of a flame type.

Figure 6:
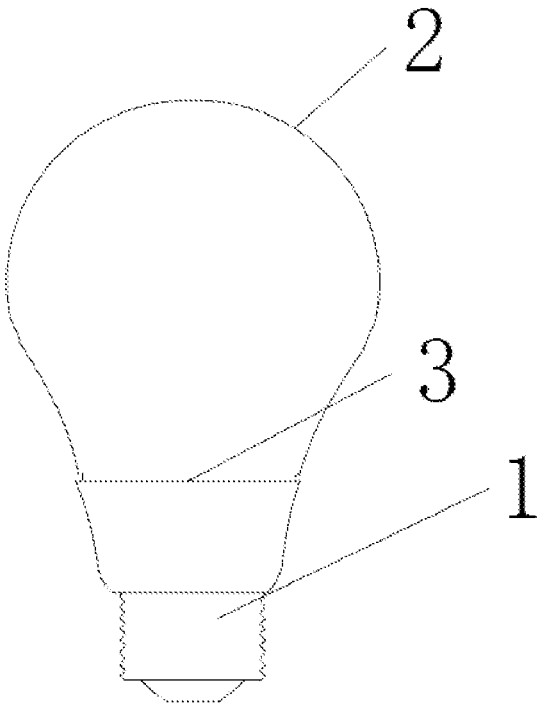
FIG. 6 shows the structural view of the embodiment 5.

Compared with the embodiment 1, the embodiment 5 shown by the FIG. 6 is characterized in that the driving circuit board 32 is a of plane round plate shape, LED lights 31 are distributed on the frontage surface of the driving circuit board 32, and the driving circuit board 32 is electrically connected with the light holder 1.

Figure 7:
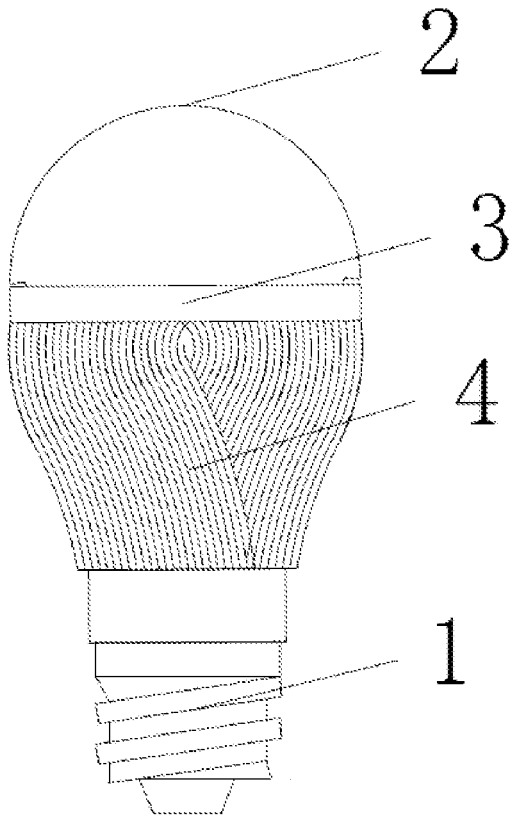
FIG. 7 shows the structural view of the embodiment 6.
Figure 8:
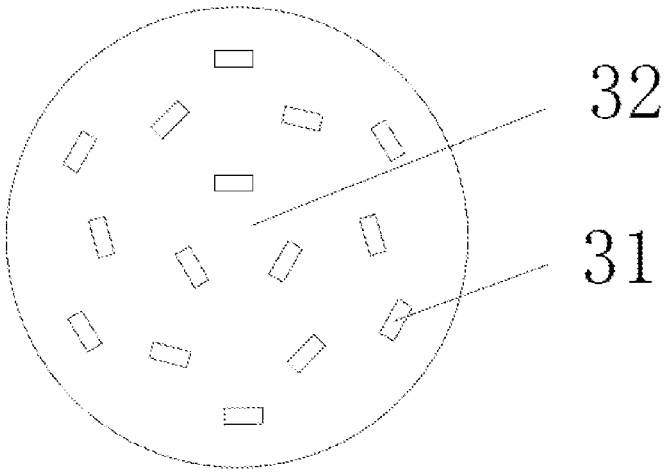
FIG. 8 shows the front view of the light-emitting body in a flat-plate-shape.

Compared with the embodiment 1, the embodiment 6 shown by the FIG. 7 is characterized that the driving circuit board 32 is of a plane round plate shape, the LED lights are distributed on the frontage of the driving circuit board 32; the driving circuit board 32 is electrically connected with the light holder 1; a heat radiator 4 is also installed between the back surface of the driving circuit board and the light holder 1; and the appearance of the light cover 2 is also can be designed into different appearances according to different occasions as required.

The embodiments above are intended for providing understanding of the invention, and not for limiting the scope of the invention. Based on the technical scheme described in the claims, those common persons skilled in the art can also make various modifications and variations, which should be construed as still falling into the scope of protection for the invention.

What is claimed is:

1. A LED light bulb, characterized by comprising:

a light holder which is internally provided with a metal element for connecting a power supply;

a light cover which is hollow and is installed on the light holder; and an LED light-emitting body consisting of a plurality of LED lights and a driving circuit board comprising an outer surface toward the light cover, wherein the plurality of LED lights are distributed on the outer surface of the driving circuit board and electrically connected with the driving circuit board, and lights from the plurality of LED lights directly emits to the light cover; the driving circuit board is directly and electrically connected with the light holder; and the LED light-emitting body is installed in the light cover.

2. The LED light bulb according to claim 1, characterized in that the driving circuit board is of a strip shape.

3. The LED light bulb according to claim 2, characterized in that the top end of the driving circuit board is bent into an annular shape, and the LED lights are distributed on the outer surface of the annular driving circuit board.

4. The LED light bulb according to claim 2, characterized in that the driving circuit board is bent into a water-drop shape, and LED lights are distributed on the outer surface of the water-drop-shaped driving circuit board.

5. The LED light bulb according to claim 1, characterized in that the driving circuit board is of a flat-plate-type structure, and LED lights are distributed on the frontage surface of the driving circuit board.

6. The LED light bulb according to claim 5, characterized in that a heat radiator is also installed on the back surface of the driving circuit board.

7. The LED light bulb according to claim 1, characterized in that the appearance of the light cover is spherical.

8. The LED light bulb according to claim 1, characterized in that the appearance of the light cover is olivary.

9. The LED light bulb according to claim 1, characterized in that the appearance of the light cover is of a flame type.

10. The LED light bulb according to claim 1, characterized in that the plurality of LED lights are distributed on the outer surface of the driving circuit board irregularly.

* * * * *